United States Patent [19]

Insley

[11] Patent Number: 4,960,976

[45] Date of Patent: Oct. 2, 1990

[54] ELECTRICAL RESISTANCE WATER HEATER EFFECTING NON-LAMELLAR FLOW TO AVERT CAVITATION THEREIN

[75] Inventor: Harold Insley, Bridgeport, Conn.

[73] Assignee: Creative Capital Corp., Greenwich, Conn.

[21] Appl. No.: 215,597

[22] Filed: Jul. 6, 1988

[51] Int. Cl.[5] ..... F24H 1/10; H05B 3/24

[52] U.S. Cl. ..... 392/485; 392/491

[58] Field of Search ..... 219/303–305, 219/306–309, 299, 296, 368

[56] References Cited

U.S. PATENT DOCUMENTS

| | | | |
|---|---|---|---|
| 1,859,939 | 5/1932 | Staley | 219/307 |
| 2,737,169 | 3/1956 | Kimberlin | 219/306 |
| 3,099,737 | 7/1963 | Naxon | 219/307 |
| 4,410,791 | 10/1983 | Eastep | 219/307 |

FOREIGN PATENT DOCUMENTS

| | | | |
|---|---|---|---|
| 0341619 | 7/1936 | Italy | 219/307 |
| 0084676 | 7/1981 | Japan | 219/307 |
| 2092282 | 8/1982 | United Kingdom | 219/306 |

*Primary Examiner*—M. H. Paschall

*Attorney, Agent, or Firm*—Robin, Blecker, Daley & Driscoll

[57] ABSTRACT

An electrical resistance heater includes interior surface bounding a fluid passage therein configured so as to disrupt lamellar flow of fluid and impart cross-mixing to the fluid. In specific construction, heaters herein include a housing, or heating cartridge insert to the housing, having a fluid inlet port and a fluid outlet port, a fluid passage extending longitudinally with the housing between the fluid inlet port and the fluid outlet port and bounded in part by surface which is configured to impart lateral displacement to fluid traversing the passage, and an electrical resistance heater disposed in such passage.

6 Claims, 4 Drawing Sheets

ELECTRICAL RESISTANCE WATER HEATER EFFECTING NON-LAMELLAR FLOW TO AVERT CAVITATION THEREIN

FIELD OF THE INVENTION

This invention relates generally to the heating of fluid media and pertains more particularly to the electrical resistance heating of water.

BACKGROUND OF THE INVENTION

It is customary to configure electrical resistance heaters with a bare electrical conductor in filament form spirally wound about the central axis of a cylindrical cavity in the heater housing and to provide water inlet and outlet ports of the housing in communication with the cylindrical cavity.

At low rates of flow, e.g., three-tenths to four-tenths of a gallon per minute, the flow through the tube is lamellar, such that there is little cross-mixing. As a consequence, the water flowing in close proximity to the filament can become overheated and cause cavitation, wherein air collects in a large bubble and the filament burns out. Thus, the burned out portion experiences heating in air at a Watts density that is only suitable for totally submerged operation. Such events are manifestly operational shortcomings of known heaters which lessen their effectiveness.

SUMMARY OF THE INVENTION

The present invention has as its primary object the provision of improved electrical resistance heaters.

It is a more particular object of the invention to provide electrical resistance heaters having less susceptibility to the above-discussed operational shortcoming.

In attaining these and other objects, the invention provides, in its broad aspect, an electrical resistance heater incorporating structure inducing non-lamellar flow of fluid therethrough and accordingly averting cavitation.

To this end, heaters in accordance with the invention configure the housing bounding the heating cavity so as to disrupt the conventional lamellar flow of fluid and to impart cross-mixing to the fluid, i.e., transverse flow thereof. In more specific construction, heaters herein include a housing having a fluid inlet port and a fluid outlet port, a fluid passage extending longitudinally with the housing between the fluid inlet port and the fluid outlet port and bounded in part by interior surface of the housing which is configured to impart lateral displacement to fluid traversing the passage, and an electrical resistance heater disposed in such passage.

The foregoing and other objects and features of the invention will be further understood from the following detailed description of preferred embodiments thereof and from the drawings wherein like reference numerals identify like parts and components throughout.

DETAILED DESCRIPTION OF PREFERRED EMBODIMENTS AND PRACTICES

Figure 2:
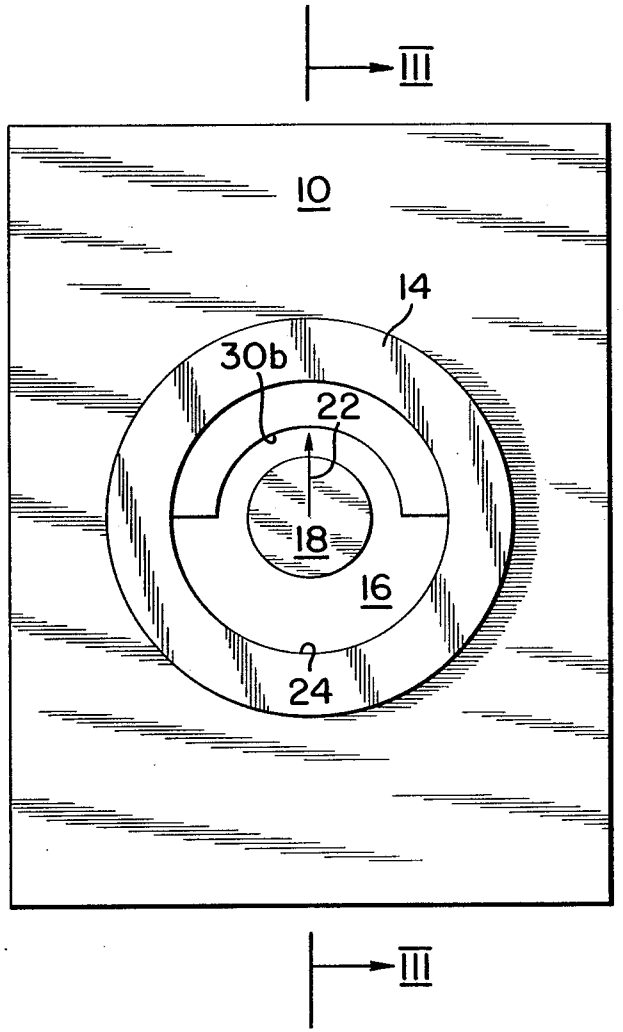
FIG. 2 is a right side elevational view of the FIG. 1 heater.
Figure 1:
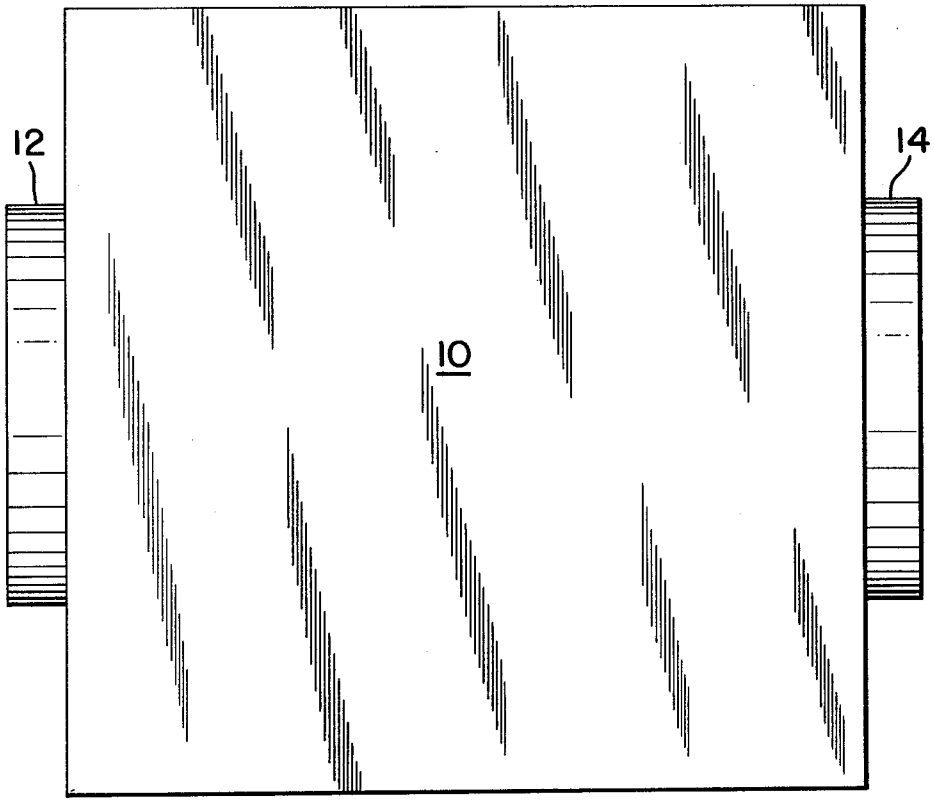
FIG. 1 is a front elevational view of an electrical resistance heater.
Figure 4:
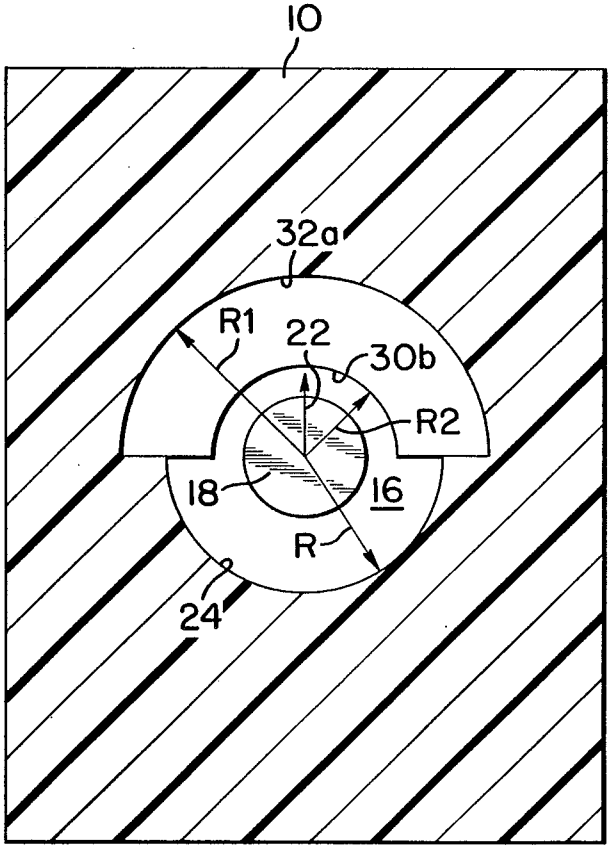
FIG. 4 is a sectional view of the FIG. 1 heater as would be seen from plane IV—IV of FIG. 3.
Figure 3:
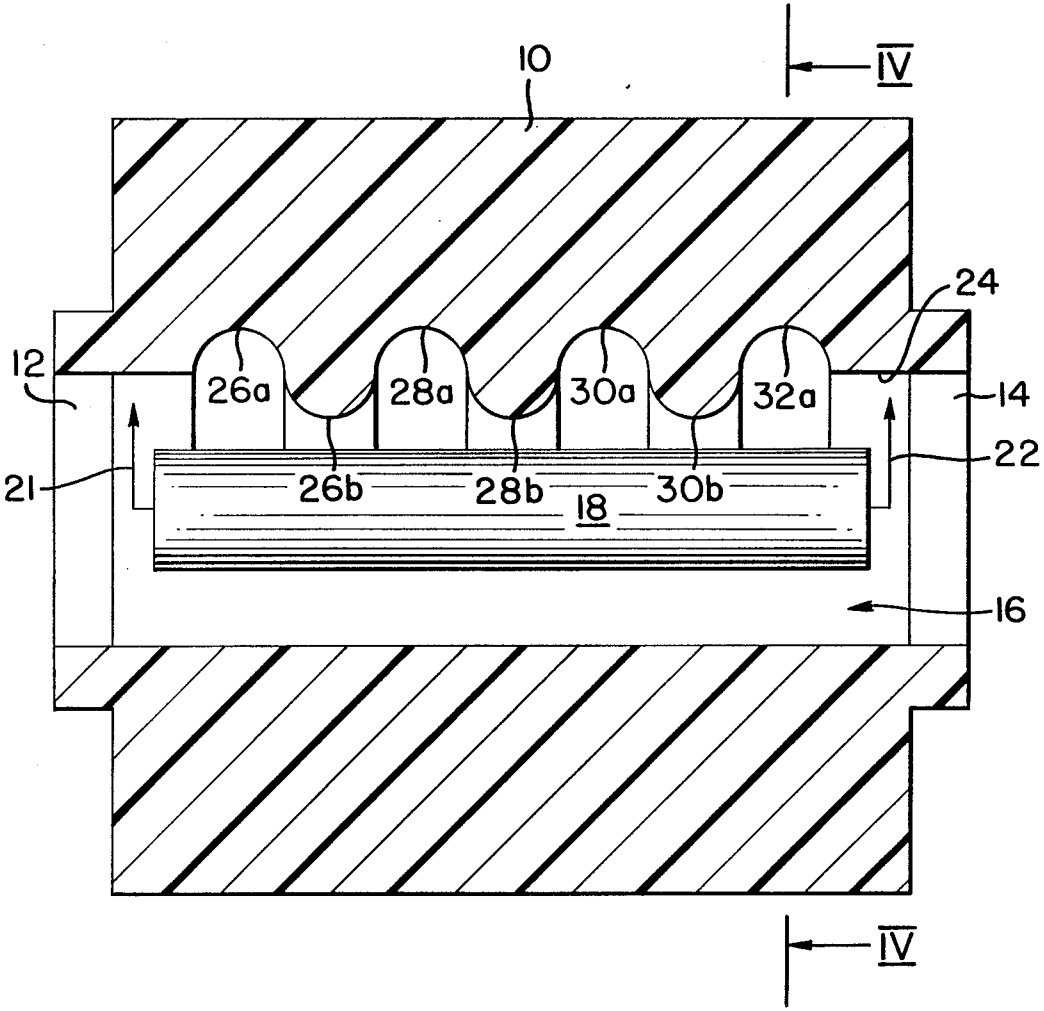
FIG. 3 is a sectional view of the FIG. 1 heater as would be seen from plane III—III of FIG. 2.

Referring to FIGS. 1 through 4, the depicted heater assembly includes housing 10 having inlet port 12 and outlet port 14. Fluid passage 16 extends between ports 12 and 14 and electrical resistance heater unit 18 in the form of a filament is suitably supported in passage 16 with excitation lines 20 and 22 extending outwardly of housing 10. Detailed structure for unit 18 and support thereof are schematically indicated throughout the drawings, since the same are shown in various prior art patents and incorporating reference is made below in this respect to a copending patent application.

Interior surface 24 of housing 10 bounds passage 16 and is generally cylindrical in configuration at radius R, however, departing from such configuration to greater radius R1 at surface portions 26*a*, 28*a*, 30*a* and 32*a* and to lesser radius R2 at surface portions 26*b*, 28*b* and 30*b*, which extend semicircularly of the housing. Such surface portions impart lateral displacement to fluid confronting the same, thus disrupting otherwise existing lamellar flow at low rates of flow, e.g., three-tenths to four-tenths of a gallon per minute, and averting cavitation found to occur at such rates attending such lamellar flow. As will be seen, radius R1 exceeds radius R and radius R exceeds radius R1.

Figure 6:
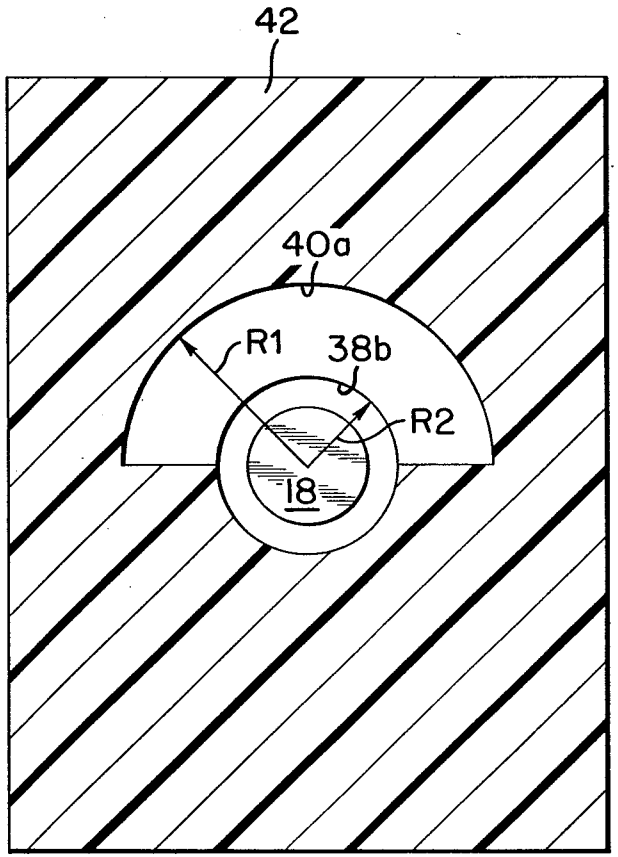
FIG. 6 is a sectional view of the second heater as would be seen from plane VI—VI of FIG. 5.
Figure 5:
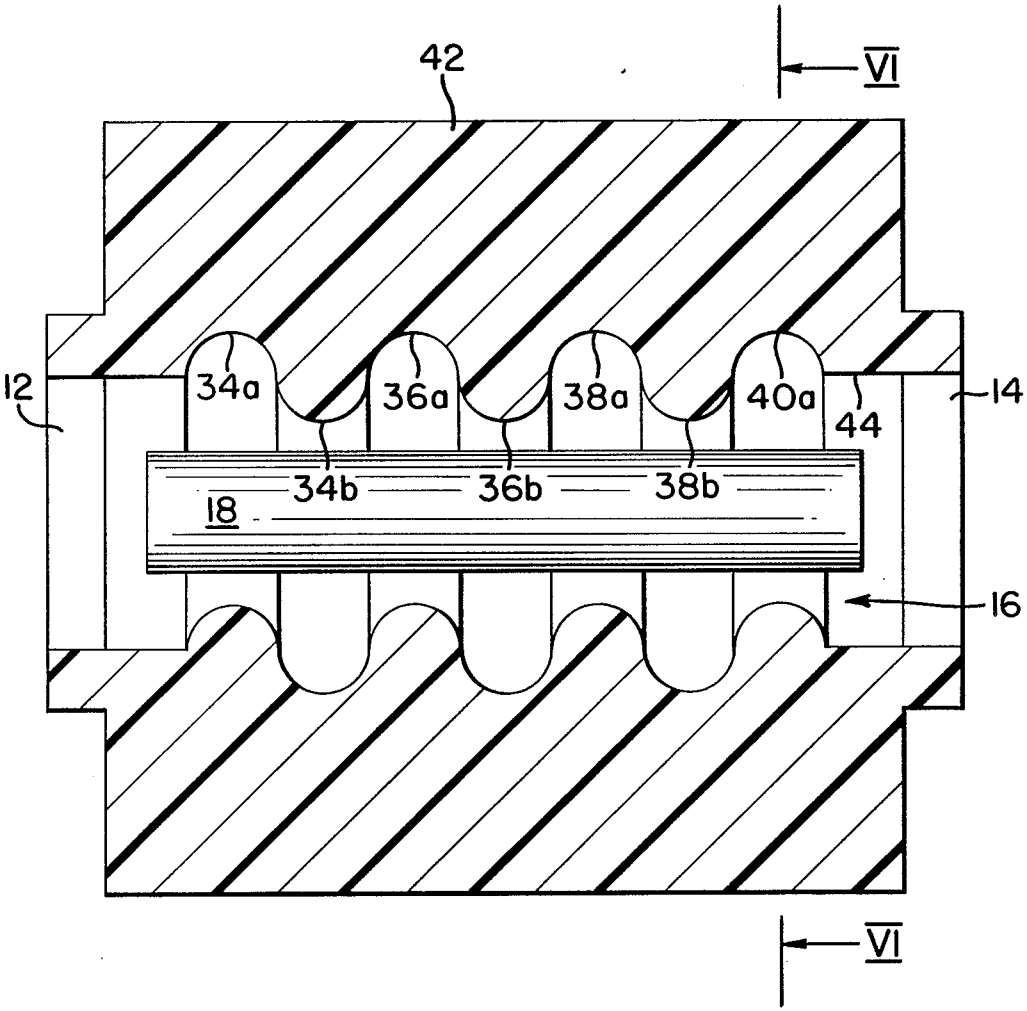
FIG. 5 is a central sectional view of a second heater in accordance with the invention.

Turning to FIGS. 5 and 6, a second heater embodiment is illustrated which differs from the embodiment of FIGS. 1–4 in that surface portions 34*a*, 36*a*, 38*a* and 40*a* extend fully perimetrically about passage 16, as do surface portions 34*b*, 36*b* and 38*b*. In this embodiment, interior surface 44 undulates lengthwise of housing 42 and may take on sinusoidal or other configuration than that illustrated. As in the case of the embodiment of FIGS. 1–4, such surface portions impart lateral displacement to fluid confronting the same, thus disrupting otherwise existing lamellar flow at low rates of flow and averting cavitation.

Figure 8:
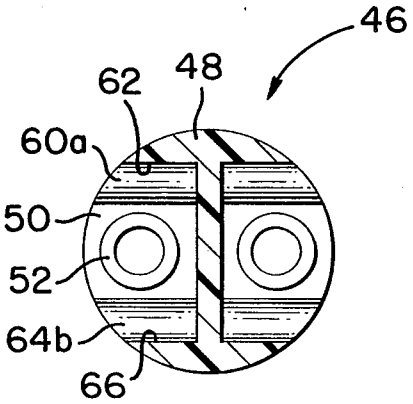
FIG. 8 is a sectional view of the third heater as would be seen from plane VII—VII of FIG. 7.
Figure 7:
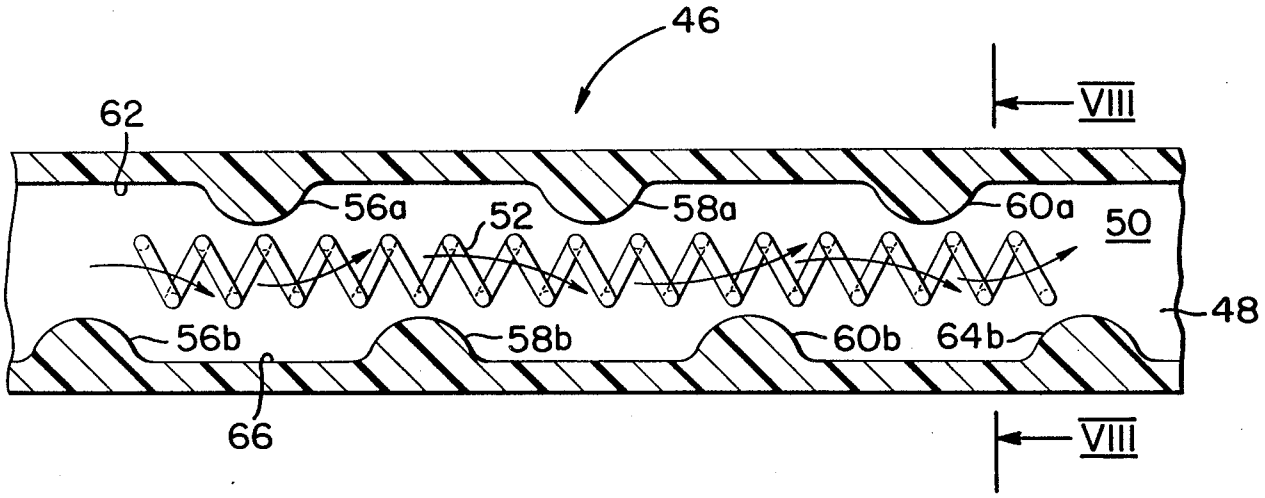
FIG. 7 is central sectional view of a third heater in accordance with the invention.

Turning to FIGS. 7 and 8, a third heater embodiment is illustrated, showing a cartridge-type of heating element unit which is insertable in a parent housing and removable for replacement purposes on failure. Incorporating reference is made to copending, allowed U.S. application Ser. No. 894,269, filed on Aug. 7, 1986. Such application discloses the type of parent housing and insertable cartridge heating element unit and structural detail connected therewith, such as that alluded to below and not shown in the drawings herein.

In FIGS. 5 and 6, cartridge 46 includes a generally I-shaped channel member 48 defining two generally rectangular compartments, the leftward compartment 50 having heating element 52 supported therein and in communication with an inlet port at one end. A channel at the other end of compartment 50 bridges over to rightward compartment 54. Compartment 54 in turn is in communication with an outlet port located adjacent such inlet port. Heating element 52 may also be conducted through the bridging channel to extend also through compartment 54.

Deflector surfaces 56*a*, 58*a* and 60*a* extend inwardly of upper cartridge surface 62 and are configured in semicircular form lengthwise of cartridge 46. Deflector surfaces 56*b*, 58*b*, 60*b* and 64*b* likewise extend inwardly of lower cartridge surface 66 and are configured semicircularly lengthwise of the cartridge. As will also be seen surfaces 56*a*–60*a* are staggered with respect to surfaces 56*b*–64*b* lengthwise of the cartridge, as in the case of the embodiment of FIGS. 1–4 and that of FIGS. 5–6, and such deflector surfaces are also effective to cross-mix or impart lateral displacement to fluid confronting the same, thus disrupting otherwise existing lamellar flow at low rates of flow and averting cavitation.

Various changes may be introduced in the foregoing embodiments without departing from the invention. Accordingly, it is to be understood that the described and discussed preferred embodiments and practices are intended in an illustrative and not in a limiting sense. The true spirit and scope of the invention is set forth in the following claims.

What is claimed is:

1. An electrical resistance heater comprising an elongate housing, a heating element cartridge disposed in said housing, said cartridge defining a fluid flow passage extending longitudinally therethrough, said cartridge having interior surface bounding said passage and including deflector portions extending from said surface into said passage, said deflector portions being configured to induce non-lamellar flow through said passage and thereby avert cavitation therein, a fluid inlet port and a fluid outlet port in flow communication with said passage, and an electrical resistance element extending longitudinally in said passage in spaced relation to said interior surface.

2. The invention claimed in claim 1 wherein said interior surface comprises opposed first and second surfaces having deflector portions extending therefrom into said passage.

3. The invention claimed in claim 2 wherein the deflector portions of said first surface are staggered with respect to the deflector portions of said second surface longitudinally of said passage.

4. The invention claimed in claim 3 wherein said deflector portions are each configured semicircularly lengthwise of said passage.

5. The invention claimed in claim 1 wherein said housing interior surface is configured with successive lengthwise portions thereof at respective different radii with respect to the central axis of said passage.

6. The invention claimed in claim 5 wherein said successive lengthwise portions of said housing interior surface each extend fully perimetrically of said passage. extending lengthwise of the housing between said fluid inlet port and said fluid outlet port and bounded in part by interior surface of the housing which is configured to impart lateral displacement to fluid traversing said passage, and an electrical resistance heater disposed in such passage.

* * * * *

UNITED STATES PATENT AND TRADEMARK OFFICE

CERTIFICATE OF CORRECTION

PATENT NO. : 4,960,976

DATED : October 2, 1990

INVENTOR(S) : Harold Insley

It is certified that error appears in the above-identified patent and that said Letters Patent is hereby corrected as shown below:

Col. 4, lines 24-29. Delete completely.

Signed and Sealed this

Twenty-eighth Day of July, 1992

*Attest:*

DOUGLAS B. COMER

*Attesting Officer*

*Acting Commissioner of Patents and Trademarks*